US010011973B1

(12) United States Patent
Ellis et al.

(10) Patent No.: US 10,011,973 B1
(45) Date of Patent: Jul. 3, 2018

(54) COLUMN DEMOLISHING TOOL

(71) Applicant: Caterpillar Inc., Peoria, IL (US)

(72) Inventors: Steven B. Ellis, Hewitt, TX (US); Ryan A. Rochel, China Spring, TX (US)

(73) Assignee: Caterpillar Inc., Deerfield, IL (US)

( * ) Notice: Subject to any disclaimer, the term of this patent is extended or adjusted under 35 U.S.C. 154(b) by 0 days.

(21) Appl. No.: 15/372,899

(22) Filed: Dec. 8, 2016

(51) Int. Cl.
*E02D 9/00* (2006.01)
*E02F 3/96* (2006.01)
*E04G 23/08* (2006.01)

(52) U.S. Cl.
CPC ..... *E02F 3/965* (2013.01); *E04G 23/082* (2013.01); *E02D 9/00* (2013.01); *E02F 3/963* (2013.01)

(58) Field of Classification Search
CPC ..... E04G 23/082; E02D 9/00; E02D 9/04
USPC ..... 299/73–77, 39.1, 39.4–39.6; 125/23.01; 451/352, 358; 83/485, 487, 488, 513, 83/928; 30/96, 102; 144/336, 339, 34.1, 144/34.5, 334
See application file for complete search history.

(56) References Cited

U.S. PATENT DOCUMENTS 4,124,015 A 11/1978 Isaksson
4,318,391 A 3/1982 Wachs et al.
4,480,627 A 11/1984 van der Toorn
6,431,655 B1 8/2002 Mantovani
6,438,874 B1 8/2002 LaBounty et al.
6,626,500 B1 9/2003 Cribb et al.
9,556,636 B2 * 1/2017 Zavitz ..... F03D 13/10

FOREIGN PATENT DOCUMENTS

CN 103374914 A 10/2013
CN 103498472 A 1/2014
JP 60-148925 A * 8/1985
JP 64-17932 * 1/1989

OTHER PUBLICATIONS

Drumcutters International Inc., Action Gallery, webpage downloaded from the Internet on Dec. 8, 2016, at http://www.drumcutters.com/gallery.

* cited by examiner

*Primary Examiner* — Sunil Singh
(74) *Attorney, Agent, or Firm* — Leydig, Voit & Mayer, Ltd.

(57) ABSTRACT

A tool for demolishing a column, including a tool frame defining an interior work space. The interior work space is sized and shaped to at least partially surround a portion of the column. A support frame is disposed in the interior work space of the tool frame, the support frame including a tool support that is displaceable within the interior work space. A milling tool is rotatably disposed on the support frame and displaceable therewith to engage the column when the tool frame is positioned around the portion of the column. A hydraulic cylinder is attached between the tool frame and the support frame and configured to forcibly displace the support frame and milling tool within the interior work space. A motor is configured to rotate the milling tool.

16 Claims, 4 Drawing Sheets

COLUMN DEMOLISHING TOOL

TECHNICAL FIELD

This disclosure relates generally to tools and methods for demolishing column shaped structures and work machines with column demolishing tools.

BACKGROUND

When buildings, bridges and similar structures are to be demolished there are diverse techniques are known for demolishing the structures. In particular, the structures may include a number of columns typically used to support the structure. The columns are pole-shaped constructions that may be made of concrete and may include steel reinforcements.

One of these known techniques is to place explosives at strategically chosen positions and causing detonation of the explosives in the expectation and hope that the structure will thereby collapse. A drawback of this known technique however is that when the explosives are detonated debris can fall in the wide vicinity, so that elaborate measures are necessary to guarantee the safety of the surrounding area. Yet another aspect is the noise nuisance. A detonation of explosives is accompanied by tremendous noise. Various drawbacks of the use of explosives are thus known.

Another of these known techniques employs a single hammer, which in use requires carefully placement of multiple impacts. Yet another technique employs column drivers that strike the column from multiple sides but have bending loads in the tools that are suspended from a crane above.

The disclosed system is directed to overcoming one or more of the problems set forth above and/or other problems of the prior art.

SUMMARY

The present disclosure is generally directed in one aspect, to a tool for demolishing a column, including a tool frame defining an interior work space. The interior work space is sized and shaped to at least partially surround a portion of the column. A support frame is disposed in the interior work space of the tool frame, the support frame including a tool support that is displaceable within the interior work space. A milling tool is rotatably disposed on the support frame and displaceable therewith to engage the column when the tool frame is positioned around the portion of the column. A hydraulic cylinder is attached between the tool frame and the support frame and configured to forcibly displace the support frame and milling tool within the interior work space. A motor is configured to rotate the milling tool.

In another aspect, the present disclosure includes a method of operating a demolition tool, the demolition tool including a tool frame defining an interior work space and at least one milling tool rotatably and drivingly arranged on the frame, including moving the milling tool into the interior work space and against the column. The tool frame is positioned about a vertical column at or near an uppermost position thereof. The milling tool is rotated in a top-down direction to demolish the column and the demolition tool is permitted to descend as the column is demolished.

DETAILED DESCRIPTION

Figure 1:
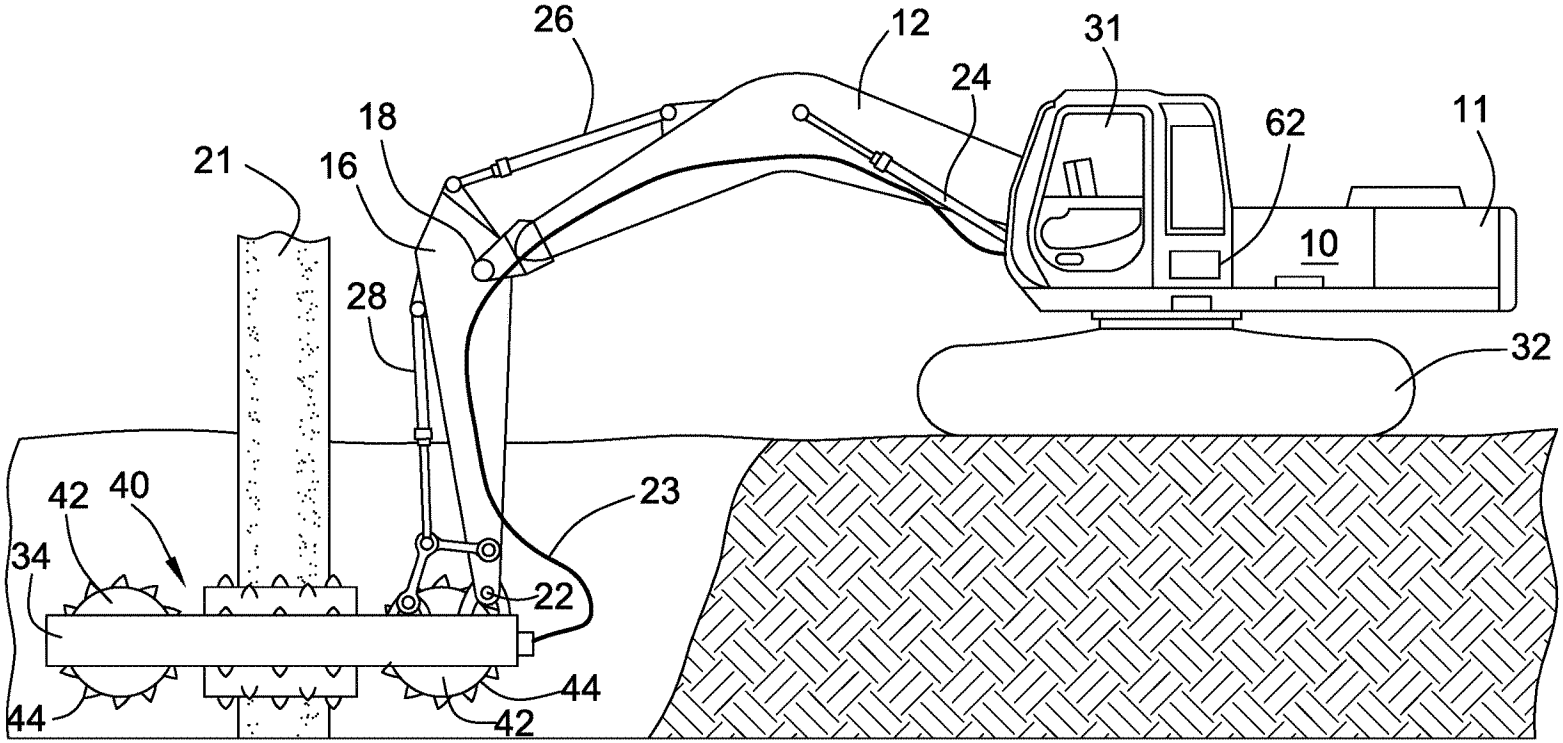
FIG. 1 is a diagram of a work machine and a demolition tool according to an embodiment of the disclosure.

FIG. 1 illustrates a work machine 10, which may be an excavator, incorporating an embodiment of the disclosure. The work machine includes a chassis 11, a boom 12 pivotally secured to the chassis 11 at a first pivot joint (not shown), a stick 16 pivotally secured to the boom 12 at a second pivot joint 18, and a demolition tool 20 pivotally secured to the stick 16 at a third pivot joint 22. First, second and third hydraulic devices, comprising first, second, and third hydraulic cylinders 24, 26, and 28, are provided to move the boom 12, stick 16, and demolition tool 20. Demolition tool 20 is supplied with hydraulic and/or electrical power 23 as is well known. The demolition tool 20 is shown disposed about a column 21 and is shaped, sized and configured to receive and, in operation, demolish the column.

For purposes of the present disclosure, the column 21 may be any structural or similar element that is elongate, for example cylindrical. The column 21 may be circular or rectangular in cross section, but may be any suitable elongate shape. Typically, columns 21 are structural elements in buildings, bridges, overpasses and so on, but may be found in other applications. Columns 21 may be concrete or reinforced concrete or constructed of other materials.

The chassis 11 carries an operator cab 31. The cab 31 is supported on an undercarriage support and transport 32, which may include track belts that facilitate the movement of the work machine 10 over a worksite. The chassis 11 and the components it carries can be rotated about a generally vertical axis by any well known mechanism, with respect to the undercarriage support and transport 32 to place the demolition tool 20 at the precise location needed for operation.

It should be appreciated that although the demolition tool is shown operated with an excavator, the demolition tool may be carried by, positioned and operated by any suitable work machine having the capability of connecting to, positioning and/or operating the demolition tool including work machines with variable angle booms and other attachment and control mechanisms and other work machines such as cranes.

Figure 2:
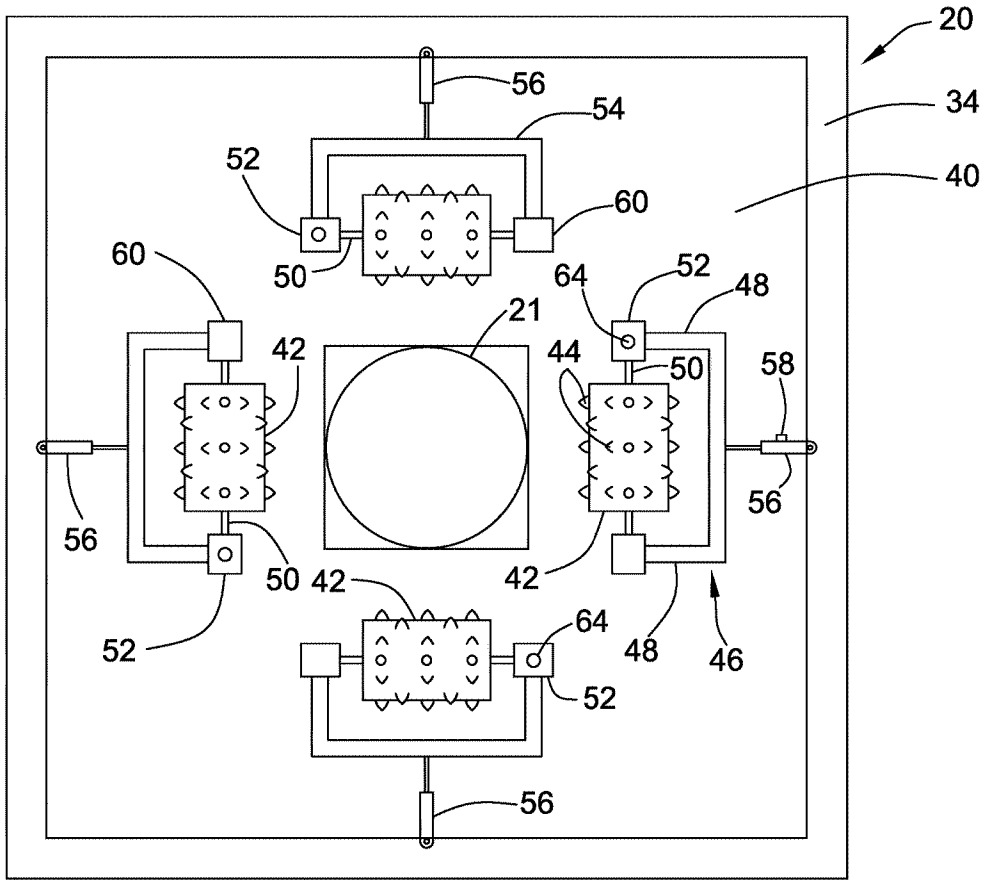
FIG. 2 is a top plan view of the demolition tool according to one embodiment of the disclosure.
Figure 3:
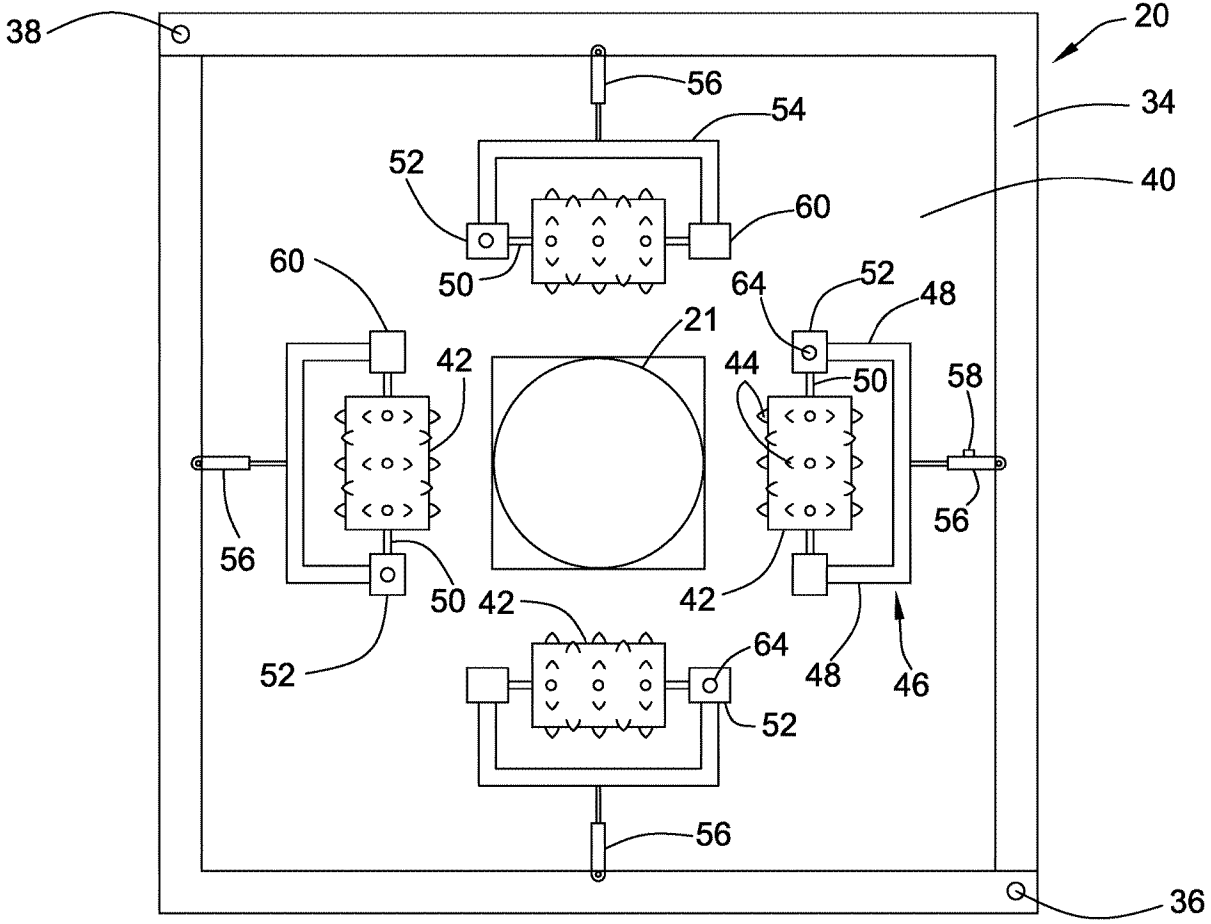
FIG. 3 is a top plan view of the demolition tool according to another embodiment of the disclosure.
Figure 4:
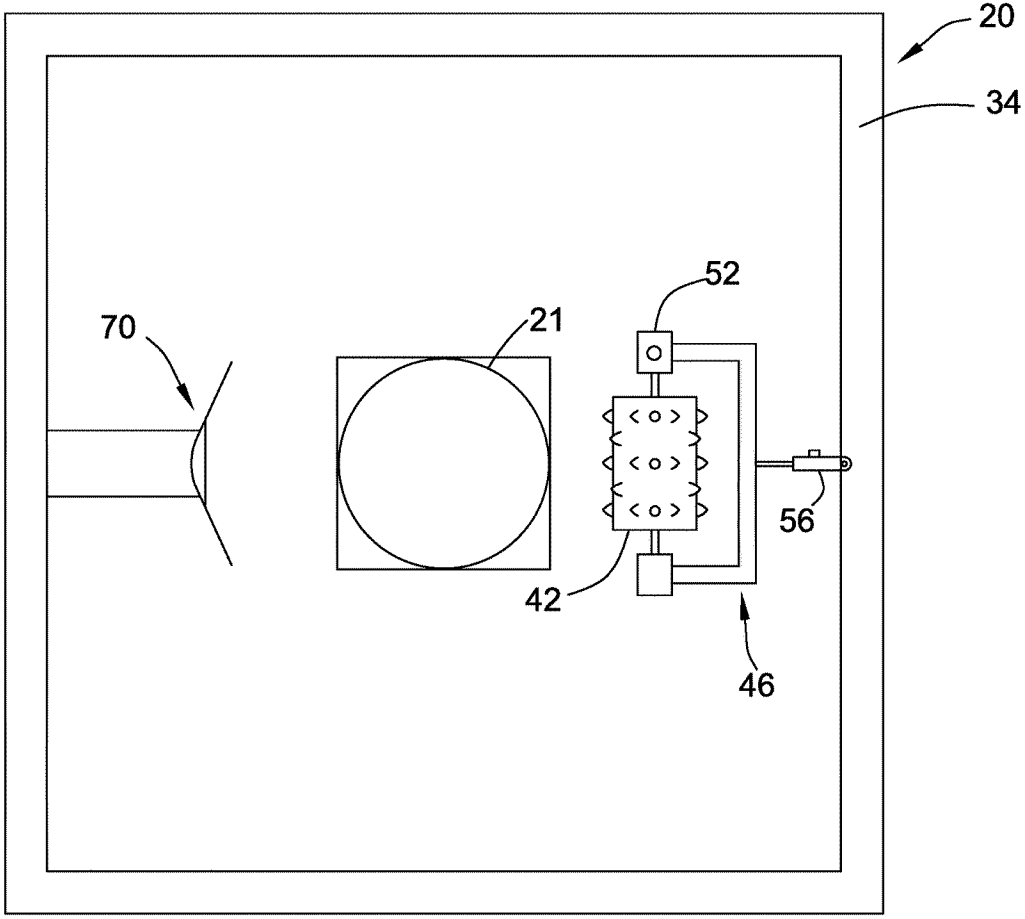
FIG. 4 is a top plan view of the demolition tool according to yet another embodiment of the disclosure.

Turning to FIGS. 2, 3 and 4, the demolition tool 20 includes a tool frame 34. The tool frame 34 may be rectangular, circular, triangular, hexagonal or any shape that can accommodate a column positioned within the frame with room for the various demolition elements detailed hereinbelow. The tool frame 34 may be formed of steel or any suitable, highly strong material such as typically found in construction and demolition equipment.

One embodiment of the tool frame 34 is formed as a single, unitary construction. However, the tool frame 34 may be formed of multiple parts. One embodiment of the tool frame 34, illustrated in FIG. 2, includes a hinge 36, which permits the tool frame to be opened to receive a column 21. In an embodiment with a hinge 36, the tool frame 34 will also include a closure 38, such as a pin or other element to secure the tool frame in a closed position.

The tool frame 34 defines an interior work space 40. The work space 40 is shaped and sized to receive the workpiece, for example column 21. The work space 40 also must accommodate the elements of the demolition tool 20 that effect demolition of the column.

Demolition of the column 21 is performed by a milling tool 42 positioned within the work space 40. In one embodiment, illustrated in FIG. 4, the demolition tool 20 includes a single milling tool 42. In the embodiment of FIG. 4, the tool frame 34 may include a cradle 70 to brace the tool frame against the column 21 and stabilize the demolition tool 20. The cradle 70 may include a roller to permit vertical movement of the tool frame 34 during operation. In the embodiment of FIG. 2, there are four milling tools 42, but two or more milling tools may be arranged on the demolition tool 20.

The milling tools 42 are generally cylindrical drums provided with a plurality of cutting and/or abrading elements 44 disposed about the periphery or circumference of the drum. The cutting elements 44 may be in the form of teeth, protrusions, rectangular cutters, fingers, stub shafts or any suitable shape configured to mill concrete and the like. The demolition tool 20 may include at least one milling tool 42. However, a plurality of milling tools 42, such as two, three or four milling tools, may be preferred. Milling tools 42 of this type are well known for cold milling of roadways.

Each milling tool 42 is supported on the tool frame 34 by being rotatably mounted on a support frame 46. The support frame 46 includes a pair of support beams 48 that may be attached to the tool frame 34 and extend into the work space 40. The support beams 48 are spaced apart to receive a milling tool 42 therebetween. The support frame 46 includes a tool support 50, which extends between and attaches to the support beams 48. The tool support 50 is configured to rotatably support the milling tool 42 thereon. The support beams 48 may be extendable, for example, by having a telescopic construction, or in the alternative, the tool support 50 and support beams are constructed to allow the tool support to travel along the support beams to accommodate the linear movement of the milling tool 42.

The support frame 46 may include a rear beam 54 that extends between the support beams 48 in a position between the tool frame 34 and the milling tool 42. The support frame 46 may be a rectangular configuration including two support beams 48 connected by rear beam 54 and tool support 50. In the embodiment with a rear beam 54, the entire support frame 46 may be moved inwardly into the work space 40 and outwardly toward the tool frame 34 by a hydraulic cylinder 56. The hydraulic cylinder 56 may be connected to the tool frame 34 at one end and the support frame 46, specifically the rear beam 54 of the support frame 46, at the other end and is configured to urge the milling tool 42 inwardly and outwardly of the work space 40. The hydraulic cylinder 56 drives the milling tool 42 against the column 21 and causes engagement of the milling tool with the column. The milling tools 42 may be moved in a common plane inwardly and outwardly of the interior work space 40. The motion of the milling tools 42 may be in a horizontal plane with the tool frame 34 positioned to mill a vertical column 21. The milling tools 42 may also be moved to mill in an arcuate path if, for example, it is being used to demolish an arch or similar curved structure.

The hydraulic cylinder 56 may include at least one sensor 58, as is well known, to sense the pressure in the cylinder. The support frame 46 may also include at least one sensor 60, such as a strain gauge or a pressure sensor to sense the load on the milling tool 42. The sensors 58, 60 are in operative communication with a controller 62 to monitor the work done by the milling tool 42 and the hydraulic cylinders 56.

Each milling tool 42 is operably associated with a motor 52 configured to impart rotation to the milling tool. The motor 52 may be an electric motor or a hydraulic motor. A hydraulic motor is a mechanical actuator that converts hydraulic pressure and flow into torque and angular displacement, i.e., rotation. An electric motor is an electromechanical actuator that converts electrical current into rotation. The motor 52 may include a sensor 64 to sense the rotational speed of the associated milling tool 42. The signal from the motor sensor 64 may be sent to the controller 62. Communication between the controller 62, the motor 52, the hydraulic cylinder 56 and the various sensors 58, 60, 64 may be performed with a wired connection or a wireless connection as is well known.

The demolition tool 20 of the various embodiments may communicate with controller 62 to generate signals to direct operation of the motors 52 and hydraulic cylinders 56 during operation of the demolition tool. The controller 62 may monitor the pressure in the hydraulic cylinders 56 and the speed of motors 52 and when a selected threshold is sensed, a corrective action may be executed.

For example when a decrease in pressure from a predetermined or specified load is sensed in the hydraulic cylinder 56, the position of the milling tool 42 associated with the particular hydraulic cylinder can be advanced and urged against the column 21, to increase the effect of the milling tool. When an increase in pressure is sensed in the hydraulic cylinder 56 from a predetermined or specified load, the position of the milling tool 42 associated with the particular hydraulic cylinder can be retracted from being urged against the column 21, to decrease the load on the milling tool.

Similarly, when the controller 62 senses that a particular milling tool 42 has stopped rotating, the milling tool 42 can be retracted from being urged against the column 21, to decrease the load on the milling tool. The same effect can be performed if the load on the motor 52 exceeds a predetermined or specified load. Conversely, when the controller 62 senses that a particular milling tool 42 is rotating faster than a specified speed, the milling tool 42 can be urged against the column 21, to increase the load on the milling tool. The same effect can be performed if the load on the motor 52 drops below a predetermined or specified load.

The controller 62 may include a processor (not shown) and a memory component (not shown). The processor may be microprocessors or other processors as known in the art. In some embodiments the processor may be made up of multiple processors. The processor may execute instructions for changing fluid pressure within hydraulic cylinder 56 or the speed of the motor 52.

Such instructions may be read into or incorporated into a computer readable medium, such as the memory component or provided external to processor. Embodiments are not limited to any specific combination of hardware circuitry and software. The term "computer-readable medium" as used herein refers to any medium or combination of media that participates in providing instructions to processor for execution. Such a medium may take many forms, including but not limited to, non-volatile media, volatile media, and transmission media. Non-volatile media includes, for example, optical or magnetic disks. Volatile media includes dynamic memory. Transmission media includes coaxial cables, copper wire and fiber optics.

Common forms of computer-readable media include, for example, a floppy disk, a flexible disk, hard disk, magnetic tape, or any other magnetic medium, a CD-ROM, any other optical medium, punch cards, paper tape, any other physical medium with patterns of holes, a RAM, a PROM, and EPROM, a FLASH-EPROM, any other memory chip or cartridge, or any other medium from which a computer or processor can read.

The memory component may include any form of computer-readable media as described above. The memory component may include multiple memory components.

The controller 62 may be enclosed in a single housing. In alternative embodiments, the controller may include a plurality of components operably connected and enclosed in a plurality of housings. In embodiments the controller 62 may be located in a plurality of operably connected locations including being fixedly attached to the machine 10. The controller 62 may be configured to sense, via the sensors 58, 60, and 64, various operating conditions of the demolition tool 20 and generate a signal responsive to the sensed condition.

The demolition tool 20 of FIG. 2 includes a one-piece or closed tool frame 34. In use, the illustrated embodiment is raised to the top of a column and lowered into position where the milling tools 42 are advanced to a position where the milling tools are engaged with the material of the column. The milling tools 42 are rotated to abrade or cut into the column. Assuming that the column is oriented vertically, the milling tools are rotated to engage the sides and/or top edges in a "top down" direction. In other words, the milling tools 42 engage the column at a relatively high position and move down the column. In one operative embodiment, the weight of the demolition tool 20 provides some or all of the force applied to the column by the milling tools 42 and assists in moving the demolition tool downwardly as material is removed from the column. In use, the demolition tool 20 is positioned at an uppermost work position or near the top of the vertically aligned column and as it removes material from the column continually comes to rest at a lower work position.

Alternatively, and referring to the demolition tool 20 of FIG. 3, which includes a tool frame 34 with a hinge 36, the tool frame can be opened and positioned at or near the base of a column 21 with the column in the interior work space 40. With the tool frame 34 surrounding the column, the tool frame is closed and secured in a closed position. The milling tools 42 are positioned into engagement with the column but only to the extent that the tools are essentially touching the sides of the column. The demolition tool 20 can be activated by causing the motors 52 to turn. The demolition tool 20 then ascends the column and is raised to an initial or start position at or near the top of the column whereupon the demolition tool is operated to mill the column.

In yet another method of operation, the milling tools 42 may be operated at different speeds through different signals sent to the motors 52 by the controller 62. The effect is that the demolition tool 20 is caused to perform work about the column in a helical or non-linear pathway. Causing the demolition tool 20 to operate in a non-linear pathway down the column may be advantageous due to the shape and/or size of the column.

INDUSTRIAL APPLICABILITY

The present disclosure is applicable to demolition of columns and other elongate structures. In particular, the demolition tool of the present disclosure is applicable to demolition of columns included in buildings, concrete structures, and bridges and similar constructions. The demolition tool of the present disclosure can be a free standing device or attached to a crane or excavator or any suitable work machine.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

We claim:

1. A tool for demolishing a column, comprising:

a tool frame defining an interior work space, the interior work space sized and shaped to at least partially surround a portion of the column therein;

at least one support frame disposed in the interior work space of the tool frame, the at least one support frame including a tool support that is displaceable within the interior work space;

at least one milling tool rotatably disposed on the at least one support frame and displaceable therewith to engage the column with the tool frame positioned around the portion of the column;

at least one hydraulic cylinder attached between the tool frame and the at least one support frame and configured to forcibly displace the at least one support frame and at least one milling tool within the interior work space; at least one motor configured to rotate the at least one milling tool; and at least one sensor operatively associated with at least one of the motor, the support frame and the hydraulic cylinder, the at least one sensor configured to sense operational conditions of the tool.

2. The tool of claim 1, wherein the tool frame is generally rectangular and is formed as a single piece.

3. The tool of claim 1, wherein the tool further comprises:

a plurality of milling tools each on a respective one of a plurality of support frames;

a plurality of hydraulic cylinders, each of the plurality of cylinders configured to displace one of the plurality of support frames; and a plurality of motors, each of the motors configured to rotate one of the plurality of milling tools.

4. The tool of claim 3, wherein the plurality of milling tools are disposed about the interior work space.

5. The tool of claim 3, wherein the plurality of milling tools are displaceable in a common plane.

6. The tool of claim 1, wherein the tool frame includes a hinge and is configured to open to receive the column into the interior work space.

7. The tool of claim 1, wherein the at least one motor is one of an electric motor and a hydraulic motor.

8. The tool of claim 1, wherein the at least one support frame includes a pair of spaced support beams flanking the at least one milling tool, the at least one tool support extending between and connected to the pair of spaced support beams.

9. The tool of claim 8, wherein the at least one hydraulic cylinder causes the at least one support frame to move inwardly and outwardly of the interior work space relative to the tool frame.

10. The tool of claim 8, wherein the at least one support frame includes a rear beam interconnecting the pair of spaced support beams and disposed between the at least one milling tool and the tool frame.

11. The tool of claim 10, wherein the at least one hydraulic cylinder is connected to the rear beam and operates between the tool frame and the rear beam.

12. The tool of claim 1, wherein the at least one sensor includes one of a load sensor and a pressure sensor.

13. The tool of claim 12, further comprising a controller configured to communicate with the at least one sensor to monitor the operational conditions.

14. The tool of claim 13, wherein the controller is configured to adjust operation of the tool based on the sensed operational conditions.

15. The tool of claim 14, wherein the sensed operational conditions include at least one of a load, a rotational speed, and a hydraulic pressure of the tool.

16. The tool of claim 15, wherein the sensed operational conditions correspond to operation of the at least one motor or the at least one hydraulic cylinder.

* * * * *